United States Patent [19]

Aoki et al.

[11] 4,184,458

[45] Jan. 22, 1980

[54] METHOD OF CONTROLLING FUEL INJECTION IN ENGINE AND UNIT THEREFOR

[76] Inventors: Keiji Aoki; Shigeru Uenishi, both of Susono, Japan

[73] Assignee: Toyota Jidosha Kogyo Kabushiki Kaisha, Toyota, Japan

[21] Appl. No.: 877,480

[22] Filed: Feb. 13, 1978

[30] Foreign Application Priority Data

Oct. 19, 1977 [JP] Japan ..... 52/126243

[51] Int. Cl.[2] ..... F02B 3/00

[52] U.S. Cl. ..... 123/32 EH; 123/32 EL; 123/32 EA

[58] Field of Search ..... 123/32 EA, 32 EH, 32 EL

[56] References Cited

U.S. PATENT DOCUMENTS

| | | | |
|---|---|---|---|
| 3,593,692 | 7/1971 | Scholl et al. | 123/32 EH |
| 3,750,631 | 8/1973 | Scholl et al. | 123/32 EA |
| 3,809,029 | 5/1974 | Wakamatsu et al. | 123/32 EA |
| 4,010,717 | 3/1977 | Taplin | 123/32 EH |
| 4,015,563 | 4/1977 | Drews et al. | 123/32 EH |
| 4,121,545 | 10/1978 | Mizote | 123/32 EA |

FOREIGN PATENT DOCUMENTS

| | | | |
|---|---|---|---|
| 51-124738 | 10/1976 | Japan | 123/32 EA |

*Primary Examiner*—Charles J. Myhre
*Assistant Examiner*—P. S. Lall
*Attorney, Agent, or Firm*—Stevens, Davis, Miller & Mosher

[57] ABSTRACT

A method of controlling fuel injection in an engine and an apparatus therefor, wherein a basic fuel injection quantity is determined based on the intake air flow rate of the engine and the RPM of the engine, and the basic fuel injection quantity thus determined is corrected by a correcting value commensurate to the accelerating or decelerating condition of the engine. Said correcting value corresponds to a value commensurate to a transitional fluctuating value detected which is further corrected commensurate to the RPM of the engine until the transitional fluctuating value during the accelerating or decelerating condition of the engine reaches the peak value, and to a value to be decreased from the peak value at a predetermined time constant which is further corrected commensurate to the RPM of the engine after the transitional fluctuating value has reached the peak value.

8 Claims, 8 Drawing Figures

METHOD OF CONTROLLING FUEL INJECTION IN ENGINE AND UNIT THEREFOR

BACKGROUND OF THE INVENTION

1. Field of the Invention

This invention relates to improvements of an engine comprising: a fuel injection valve in the air intake system; wherein the air-fuel ratio is controlled within a predetermined narrow range through the control by said fuel injection valve, and particularly to a fuel injection control method for controlling the air-fuel ratio of the engine constantly within a predetermined narrow range throughout all operating conditions and an apparatus therefor.

2. Description of the Prior Art

A three-way catalyzer can simultaneously purify HC, CO and NOx that are noxious components contained in exhaust gases. However, in order to effectively use this sort of catalyzer, it is necessary to control the air-fuel ratio of the engine very accurately and to maintain the value thereof within a predetermined narrow range throughout all operating conditions.

FIG. 1 illustrates the outline of the fuel injection control unit of the engine equipped with a purifying unit having a three-way catalyzer. Denoted at reference numeral 1 is the main body of the engine, 2 an intake air flow sensor, 3 an air intake pipe, 4 a throttle valve, 5 a negative pressure sensor mounted on said air intake pipe 3, 6 a fuel injection valve, 7 an ignition distributor, 8 an exhaust pipe, and 9 an exhaust gas purifying unit having a three-way catalyzer which is mounted at the intermediate portion of the exhaust pipe. Denoted at 10 is a fuel control circuit which receives a signal corresponding to the intake air flow rate detected by the intake air flow sensor 2 and a signal corresponding to the RPM of the engine detected by the ignition distributor 7 so as to control the fuel injection valve 6 to maintain the air-fuel ratio within a predetermined range.

If the quantity of the intake air per unit time is Q and the fuel injection quantity per unit time is q, the air-fuel ratio A/F of the engine is given by the following formula.

$$A/F = Q/q \quad (1)$$

If the fuel injection valve 6 injects once per rotation of the engine, one injection time (width of a injection pulse) is T and the RPM of the engine is N, the relationship therebetween is given by:

$$q \propto TN \quad (2)$$

If A/F in the formula (1) is K, the formula (1) is changed into q=KQ and q=KQ is substituted into the formula (2), the folliowing formula is obtained.

$$T \propto K \cdot Q/N \quad (3)$$

In other words, the control circuit 10 produces an ouput of a pulse width T proportional to Q/N commensurate to the RPM of the engine so as to maintain the air-fuel ratio at a certain value.

Now, during the accelerating or decelerating condition of the engine, the air-fuel ratio is deviated from the controlled air-fuel ratio due to the lags in the operations of the air intake system and the exhaust system. In other words, the negative pressure in the air intake pipe rapidly approaches the atmospheric pressure in the rapidly accelerating condition of the engine, whereby only a part of the fuel injected into the air intake pipe is vaporized and the fuel sucked into the cylinders of the engine is decreased, thus resulting in a lean air-fuel ratio. In contrast with this, in the rapidly decelerating condition of the engine, the pressure in the air intake pipe approaches the vacuum pressure and the liquid fuel in the air intake pipe is vaporized in large quantities thus resulting in a rich air-fuel ratio. To cope with said lags in the operations of the air intake system and the fuel system, with the conventional fuel injection control unit, such countermeasures have been taken that the accelerating or decelerating condition of the engine is detected by, for example, differentiating the intake air pressure or the opening degree of the throttle valve, and in the case that this differential value is larger than a predetermined value, i.e., the transitional fluctuating value becomes large to a certain extent, the fuel is increased or decreased commensurate to the transitional fluctuating value, thereby correcting the air-fuel ratio. However, even with the fuel injection control unit of the type described, it has been difficult to control the air-fuel ratio within a predetermined range due to the lag in the operation of the control system during the accelerating or decelerating condition of the engine. Therefore, with the conventional fuel injection control unit further improved, the correcting value corresponds to a value commensurate to a transitional fluctuating value detected until the transitional fluctuating value during the accelerating or decelerating condition of the engine reaches the peak value, and to a value decreased from the peak value at a definite time constant after the transitional fluctuating value has reached the peak value. Even with this conventional fuel injection control unit further improved, there has still remained such a disadvantage that the air-fuel ratio is fluctuated by the RPM of the engine.

SUMMARY OF THE INVENTION

The object of the present invention is to provide a fuel injection control method in which the air-fuel ratio of the engine can be controlled accurately and to a definite value, and a unit therefor.

According to the invention, there is provided a method of controlling fuel injection in an engine, comprising the steps of:

(a) calculating the basic fuel injection quantity based on the intake air flow rate of the engine and the RPM of the engine;

(b) detecting the transitional fluctuating value of the engine during the accelerating or decelerating condition of the engine, calculating a value corresponding to the transitional fluctuating value detected until the transitional fluctuating value detected reaches the peak value, and calculating a value to be decreased from the peak value at a definite time constant after the transitional fluctuating value detected has reached the peak value; and (c) determining the fuel injection quantity through correcting the basic fuel injection quantity calculated in said step (a) by the value calculated in the step (b);

whereby the value calculated in said step (b) is further corrected commensurate to the RPM of the engine, by which the basic fuel injection quantity calculated in the step (a) is corrected, so that the fuel injection quantity can be obtained.

Further, according to the invention there is provided a fuel injection control unit of the engine, comprising: an intake air flow sensor of the engine; an RPM detector of the engine; an arithmetic unit for calculating the basic fuel injection quantity of the engine based on the intake air flow rate detected by said intake air flow sensor and the RPM detected by said RPM detector; a detector for detecting the transitional fluctuating value of the engine during the accelerating or decelerating condition of the engine; a first correcting circuit for correcting the basic fuel injection quantity calculated in said arithmetic unit by an output from said transitional fluctuating value; and a fuel injection valve driven in accordance with an output from said correcting circuit; wherein: a second correcting circuit for correcting an output from said first correcting circuit further by an output from said RPM detector; and said fuel injection valve is driven in accordance with an output from said second correcting circuit.

The transitional fluctuating value during the accelerating or decelerating condition of the engine is obtainable by differentiating the intake air pressure, intake air flow rate, opening degree of the throttle or opening degree of the accelerating pedal, for example.

BRIEF DESCRIPTION OF THE DRAWINGS

The above mentioned and other features and objects of the present invention will become more apparent by reference to the following description taken in conjunction with the accompanying drawings, wherein like reference numerals denote like elements, and in which.

DESCRIPTION OF THE PREFERRED EMBODIMENT

Figure 1:
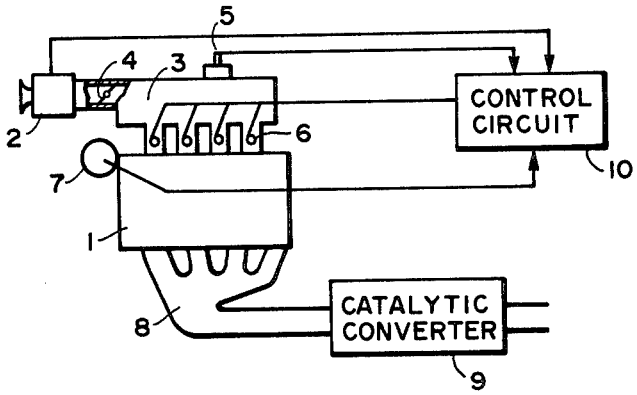
FIG. 1 is a block diagram of the control unit for controlling the fuel injection quantity based on the intake air flow rate, RPM of the engine and intake air pressure.
Figure 2:
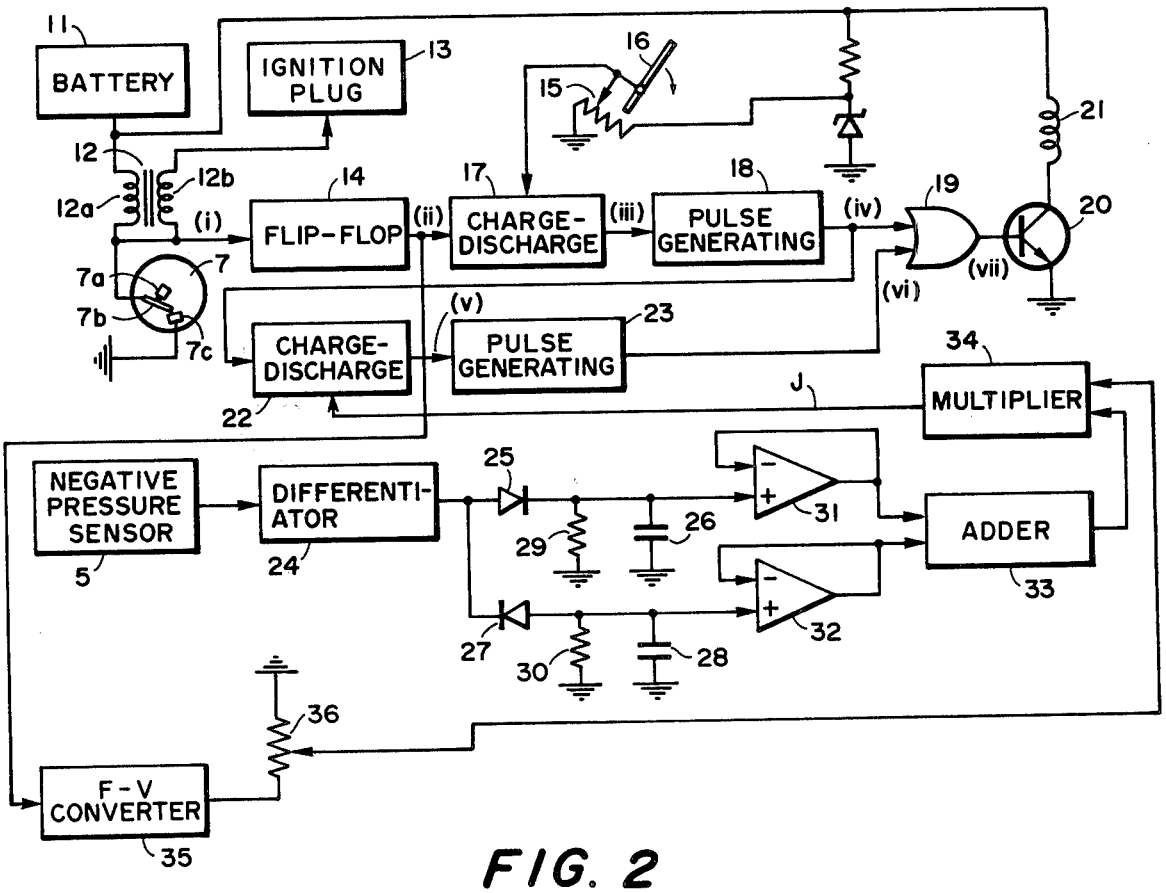
FIG. 2 is an electric circuit diagram of the fuel injection control unit embodying the present invention.

Referring to FIG. 2, an ignition distributor 7 is connected to a battery 11 via a primary winding 12*a* of an ignition coil 12. 7*a*, 7*b* and 7*c* show a rotary shaft, breaker and contact point of the distributor 7, respectively. Connected to a secondary winding 12*b* of the ignition coil is an ignition plug 13. A flip-flop 14 connected to the ignition coil 12 sends out a pulse having a pulse width commensurate to RPM of the engine. A variable resistor 15 is connected to a rotary plate 16 of the intake air flow sensor 2 and varies in its resistance value commensurate to the intake air flow rate. A charge-discharge circuit 17 is determined in its charging voltage in accordance with the pulse width of a pulse sent out from the flip-flop 14, and determined in its discharging time constant in accordance with the resistance value of the variable resistor 15. A pulse generating circuit 18 sends out a pulse having a pulse width corresponding to the period of time from start to end of discharging of the charge-discharge circuit 17. The pulse sent out from the pulse generating circuit 18 is fed to a transistor 20 via an OR-gate 19. An electromagnetic solenoid 21 for opening and closing the fuel injection valve 6 is inserted at the output end of the transistor 20. Another charge-discharge circuit 22 is determined in its charging voltage in accordance with the pulse width of a pulse generated by said pulse generating circuit 18, and determined in its discharging time constant in accordance with an output from a multiplier 34 which will be described hereinafter. A pulse generating circuit 23 sends out a pulse having a pulse width corresponding to the time from start to end of discharging of the charge-discharge circuit 22, and feeds the pulse to the transistor 20 via the OR-gate 19. Consequently, a pulse sent out from the OR-gate 19 is one in which a pulse sent out from the pulse generating circuit 18 is overlapped with a pulse sent out from the pulse generating circuit 23 on the time axis. A signal detected by a negative pressure sensor 5 and commensurate to the intake air pressure is differentiated by a differentiator 24. Said negative pressure sensor 5 and the differentiator 24 function as detectors for detecting the accelerating or decelerating condition of the engine. An output of the differentiator 24, i.e., a signal corresponding to the transitional fluctuating value of the engine, is stored in a capacitor 26 via a forward diode 25 or in a capacitor 28 via a backward diode 27. The diode 25 and capacitor 26 detect the positive transitional fluctuating value, i.e., the peak value in the transitional fluctuating value during the accelerating condition of the engine. Further, the diode 27 and capacitor 28 detect the negative transitional fluctuating value, i.e., the peak value in the transitional fluctuating value during the decelerating condition of the engine. The capacitor 26 is connected to a discharging resistor 29, whereby the capacitor 26 is discharged at a certain time constant after said capacitor is charged to the peak value of an output sent out from the differentiator 24. Likewise, the capacitor 28 is connected to a discharging resistor 30, whereby the capacitor 28 is discharged at a predetermined time constant after said capacitor is charged to the peak value of an output sent out from the differentiator 24. The voltages from the capacitors 26 and 28 are fed through buffer amplifiers 31 and 32, respectively, to an adder 33 where they are added together. An output sent out from the adder 33 is applied to one input terminal of a multiplier 34. A frequency-voltage converter 35 converts a signal from the flip-flop 14 into a voltage value and feeds it to the other input terminal of the multiplier 34 via a variable resistor 36. The multiplier 34 corrects a signal sent out from the adder 33 and corresponding to the accelerating or decelerating condition of the engine by a signal sent out from the frequency-voltage converter 35 and corresponding to the RPM of the engine, and gives a signal J thus corrected to said charge-discharge circuit 22.

Figure 3:
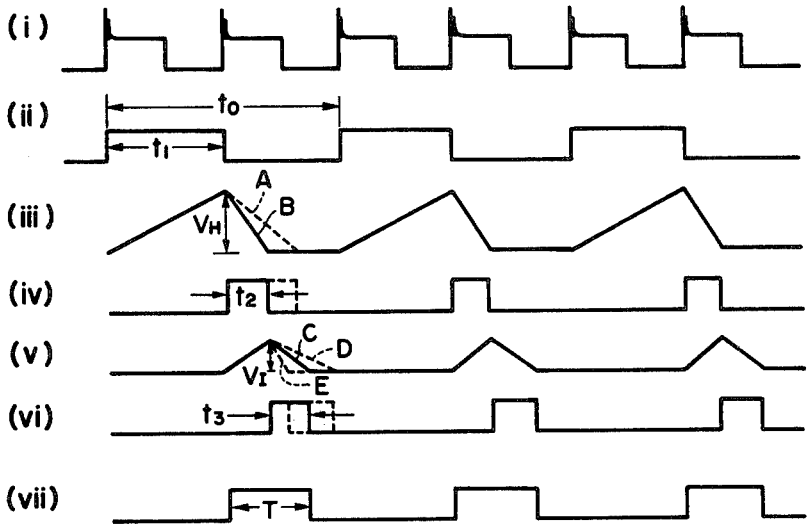
FIG. 3 is a chart illustrating the forms at various sections in the circuit diagram shown in FIG. 2.
Figure 4:
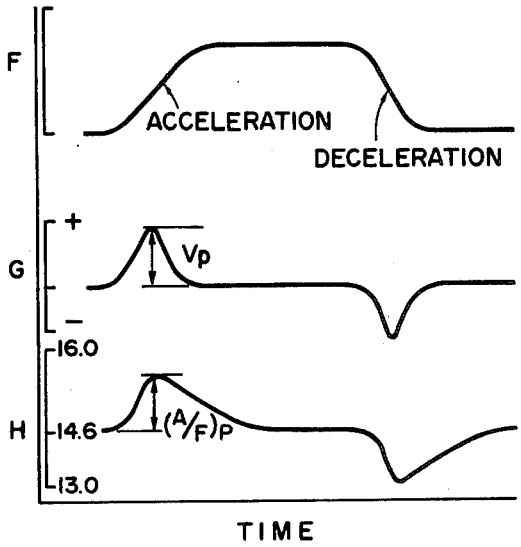
FIG. 4 is a chart showing the changes in the intake air pressure, the differential value of the intake air pressure, and the air-fuel ratio during the accelerating or decelerating condition of the engine.
Figure 5:
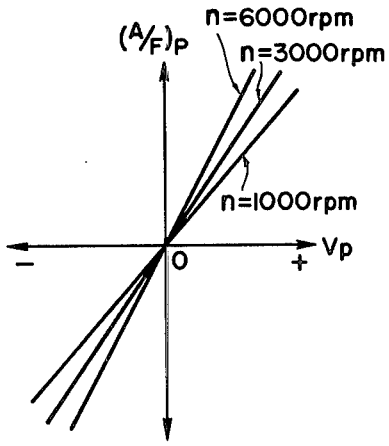
FIG. 5 is a chart showing the relationship between the peak value of the differential value of the intake air pressure and the peak value in the fluctuating value of the air-fuel ratio.

Description will hereunder be given of operation of said fuel injection control circuit with reference to FIGS. 3 to 5. The breaker 7*b* and contact point 7*c* of the distributor 7 turn on and off during running of the engine, whereby the wave form shown in FIG. 3 (i) appears in the primary winding 12*a* of the ignition coil. Upon receiving said wave form (i), the flip-flop 14 sends out the wave form shown in FIG. 3 (ii). The period $t_0$ and pulse width $t_1$ of said wave form (ii) are inversely proportional to the RPM of the engine. In other words, the higher the RPM of the engine, the shorter $t_0$ and $t_1$ become. The charge-discharge circuit 17 is charged during the time of pulse width $t_1$ of the wave form (ii). Consequently, a charging voltage value $V_H$ at the end of charge becomes low when the pulse width $t_1$ becomes shorter. That is, $V_H$ is inversely proportional to the RPM of engine. The discharging time constant at which the charge-discharge circuit 17 is discharged after having charged to $V_H$ is determined by the variable resistor 15 operationally associated with the rotary plate 16. Accordingly, the discharging time constant of the charge-discharge circuit 17 increases with the increase of the intake air flow rate. Consequently, as shown in FIG. 3 (iii), when the intake air flow rate is high, the discharge is made along the inclination shown by a dotted line A. In contrast with this, when the intake air flow rate is low, the discharge is rapidly made along the inclination shown by a solid line B. Upon receiving said wave form (iii), the pulse generating circuit 18 sends out a pulse (iv) having a pulse width $t_2$ equal to the time from start to end of discharge from the charge-discharge circuit 17. The pulse width $t_2$ of pulse (iv) sent out from the pulse generating circuit 18 is proportional to the intake air flow rate and inversely proportional to the RPM of the engine. The pulse sent out from the pulse generating circuit 18 is fed to the transistor 20 via the OR-gate 19 to turn "ON" said transistor 20. The pulse (iv) sent out from the pulse generating circuit 18 is fed to the charge-discharge circuit 22 to determine the charging voltage thereof. Accordingly, the charging voltage value $V_I$ of the charge-discharge circuit 22 comes to correspond to the pulse width $t_2$ of the wave form (iv), and said voltage value $V_I$ is proportional to the intake air flow rate, and inversely proportional to the RPM of the engine. The discharging time constant of the charge-discharge circuit 22 is determined by the output J of the multiplier 34. When the engine runs at a constant speed, the differential value of air pressure detected by the negative pressure sensor 5 is 0. Consequently, the output from the differentiator 24 becomes 0, and an output from the adder 33 is 0 also. The multiplier 34 multiplies 0 output of the adder 33 by a signal sent out from the frequency-voltage converter 35 and corresponding to the RPM of the engine, and sends out the output J for setting the discharging time constant of the charge-discharge circuit 22 at a certain value. Upon receiving the signal from the multiplier 34, the charge-discharge circuit 22 is discharged at the time constant shown by line C. The pulse generating circuit 23 generates a pulse (vi) having a pulse width corresponding to the discharge time $t_3$ of the charge-discharge circuit 22, feeds said pulse to the transistor 20 via the OR-gate. The time during which the transistor 20 is energized equals to a pulse (vii) in which the pulse (iv) sent out from the pulse generating circuit 18 is overlapped by the pulse (iv) sent out from the pulse generating circuit 23 on the time axis. The pulse width $T(=t_2+t_3)$ of said pulse (vii) is proportional to the intake air flow rate of the engine, and inversely proportional to the RPM of the engine. The electromagnetic solenoid 21 opens the fuel injection valve commensurate to the pulse width of said pulse (vii), thereby controlling the air-fuel ratio of the engine to a constant value. The intake air pressure, during the rapidly accelerating condition of the engine, increases from about vacuum pressure to about atmospheric pressure, and, during rapidly decelerating condition of the engine, decreases from about atmospheric pressure to about vacuum pressure. For example, the negative pressure in the air intake pipe is rapidly turned into the atmospheric pressure during the rapidly accelerating condition of the engine, and only a part of the fuel injected into the air intake pipe is vaporized, whereby the air-fuel ratio becomes lean as shown in FIG. 4H. Additionally, the fuel injected into the air intake pipe prior to the deceleration, partially liquefied and attached to the wall of the air intake pipe is vaporized due to the sharp rise in negative pressure during the deceleration condition of the engine, whereby the air-fuel ratio becomes rich as shown in FIG. 4H. Now, as shown in FIG. 5, a proportional relationship is established between the peak value $V_p$ of the differential value G of the intake air pressure and the then peak value $(A/F)_p$ in fluctuating value of the air-fuel ratio H with the RPM of the engine functioning as a parameter. As shown in FIG. 5, the peak value in fluctuating value of the air-fuel ratio to the same differential value of the intake air pressure increases with the increase of the RPM of the engine. Further, as apparent from the comparison between G and H in FIG. 4, such a proportional relationship as shown in FIG. 5 is established between the differential value of the intake air pressure and the fluctuating value of the air-fuel ratio until either said differential value or fluctuating value reaches the peak value. However, after either said differential value or fluctuating value has reached the peak value, the above proportional relationship disappears. That is, the differential value of the intake air pressure comparatively quickly becomes 0, whereas the fluctuating of the air-fuel ratio value slowly becomes 0 at a certain time constant. In the circuit embodying the invention shown in FIG. 2, in order to cope with the fluctuation in the air-fuel ratio during the accelerating or decelerating condition of the vehicle, the intake air pressure detected by the negative pressure sensor 5 at first is differentiated by the differentiator 24. When the output from the differentiator 24 is plus, i.e., during the accelerating condition of the engine, said plus output charges the capacitor 26 via the diode 25. Upon being charged up to the peak value of the differential value of the intake air pressure, the capacitor 26 is discharged via the resistor 29. In this case, the time constant determined by the capacitor 26 and the resistor 29 is made to coincide with the time constant to be restored after the fluctuation of the air-fuel ratio has reached the peak value, whereby the terminal voltage of the capacitor 26 varies in accordance with the fluctuation of the air-fuel ratio during the accelerating condition as shown in FIG. 4H. The terminal voltage of the capacitor 26 is fed to the multiplier 34 via the buffer amplifier 31 and the adder 33. In contrast with the above, when the output from the differentiator 24 is minus, i.e., during the decelerating condition of the engine, said minus output charges the capacitor 28 via the diode 27 up to the peak value of the differential value of the intake air pressure, and thereafter, discharged via the resistor 30. Accordingly, the terminal voltage of the capacitor 28 comes to correspond to the fluctuation of the air-fuel ratio during the decelerating condition of the engine as shown in FIG. 4H. The output from the capacitor 28 is fed to the multiplier 34 via the buffer amplifier 32 and the adder 33. Consequently, during the accelerating and decelerating conditions of the engine, a signal corresponding to the fluctuating value of the air-fuel ratio corresponding to the condition is sent out to the multiplier 34. On the other hand, the pulse sent out from the flip-flop 14 and corresponding to the RPM of the engine is converted by the frequency-voltage converter 35 into voltage and fed to one terminal of the multiplier 34 via regulating variable resistor 36, whereby the signal sent out from the adder 33 is corrected by the RPM of the engine in such a manner that the relationship shown in FIG. 5 may be established. The signal J thus corrected is fed to the charge-discharge circuit 22. When the engine is running at a constant speed, the output of the multiplier 34 is 0 as aforesaid, and the discharging time constant of the charge-discharge circuit 22 is set at a certain value. Accordingly, the then discharge curve of the charge-discharge circuit 22 is one shown in FIG. 3 (v)C. During the accelerating or decelerating condition of the engine, the multiplier 34 sends out a signal for making the discharging time constant of the charge-discharge circuit 22 larger or less than said setting value. In other words, during the accelerating condition of the engine, the discharging time constant of the charge-discharge circuit 22 is enlarged by the output from the multiplier 34, whereby its discharge curve is more easily inclined than C as shown in FIG. 3 (v)D. Consequently, the pulse generating circuit 23 generates a pulse having a pulse width corresponding to said discharge time, i.e., a pulse width larger than the pulse width $t_3$ during running at a constant speed. In this case, the discharge time of the charge-discharge circuit 22 and the pulse width of the pulse of the pulse generating circuit 23 are determined by the magnitude of a signal sent out from the multiplier 34. Likewise, during the decelerating condition of the engine, the multiplier 34 sends out a signal for making the discharging time constant of the charge-discharge circuit 22 less than said setting value. Consequently, the then discharge curve becomes more sharply inclined than C as shown in FIG. 3 (v)E. The pulse generating circuit 23 generates a pulse having a narrower pulse width than the pulse width $t_3$ during running at a constant speed of the engine in accordance with the discharging time in this case. A pulse sent out from the pulse generating circuit 23 during the accelerating or decelerating condition of the engine is overlapped by the pulse sent out from the pulse generating circuit 18 on the time axis, whereby the time during which the electromagnetic solenoid 21 keeps the fuel injection valve open is made longer than the time during the running at a constant speed in accordance with the extent of the transitional fluctuation during the accelerating condition of the engine, and made shorter than the time during the running at a constant speed in accordance with the extent of the transitional fluctuation during the decelerating condition of the engine. As described above, in this embodiment, the fuel injection quantity is determined in accordance with the intake air flow rate of the engine and the RPM of the engine during running of the engine at a constant speed, and during the accelerating or decelerating condition the fuel injection quantity determined as above is corrected in accordance with the extent of the acceleration or deceleration, thereby enabling to maintain the air-fuel ratio within a predetermined narrow range.

Figure 6:
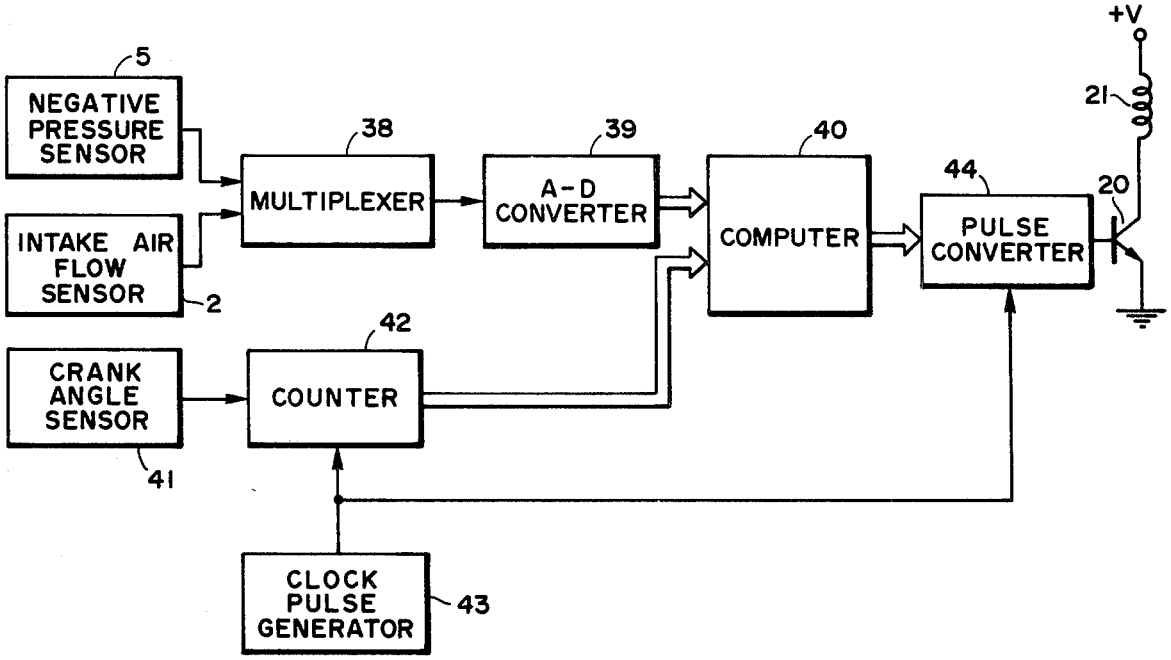
FIG. 6 is a block diagram of the electric circuit showing one embodiment of the present invention wherein the fuel injection quantity is controlled by use of a digital computer.

FIG. 6 shows an embodiment wherein the correction of the fuel injection quantity is carried out by a digital computer during the accelerating or decelerating condition of the engine. Referring to this drawing, the intake air pressure detected by the negative pressure sensor 5 and the intake air value detected by the intake air flow sensor 2 are fed through a multiplexer 38 to an analog-digital converting circuit 39 where it is converted into a digital value which will be fed to a computer 40. A crank angle sensor 41 feeds a pulse whose repeated period is commensurate to the RPM of the engine to a counter 42 which repeats the set-reset action in accordance with the pulse. The counter 42 is adapted to receive a signal from a pulse oscillator 43 as a clock input, and count the pulse only during the time commensurate to the repeated period of the pulse sent out from the crank angle sensor 41, whereby the number of pulses inversely proportional to the RPM of the engine is fed to the computer 40. The computer 40 calculates the basic fuel injection quantity in accordance with the intake air flow rate read from the intake air flow sensor 2 and the RPM of the engine read from the counter 42, corrects said basic fuel injection quantity by the differential value of the intake air pressure detected by the negative pressure sensor 5 and the RPM of the engine sent out from the counter 42 during the accelerating or decelerating condition of the engine, and feeds the fuel injection value thus corrected to a pulse converter 44 as a digital value. The pulse converter 44 converts the digital value indicating the fuel injection value sent out from the computer 40 into a pulse width and feeds it to the base of the transistor 20. Consequently, the time during which the electromagnetic solenoid 21 keeps the fuel injection valve open is commensurate to the fuel injection quantity sent out from the computer 40.

Figure 8:
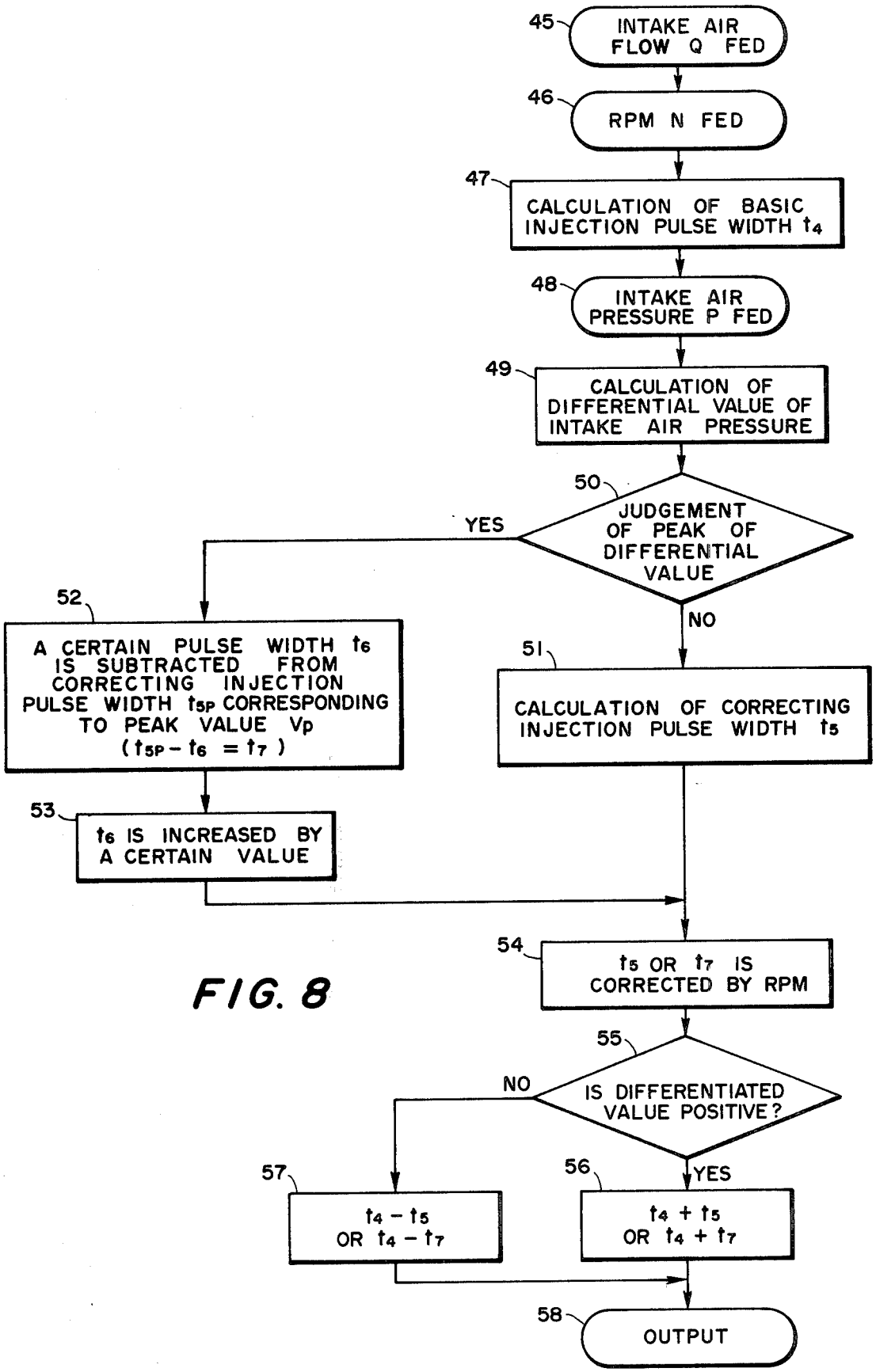
FIG. 8 is a flow chart in explanation of the operation of the embodiment shown in FIG. 6.

Detailed description will hereunder be given of the calculation process carried out by the computer 40 in the embodiment shown in FIG. 6 with reference to the flow chart in FIG. 8. Firstly, the intake air flow rate Q is fed in the step 45, and the RPM N of the engine is fed in the step 46. The basic injection pulse width $t_4$ is calculated from the intake air value Q and the RPM N of the engine in the step 47. The intake air pressure P is fed in the step 48. The differential value of the intake air pressure P is calculated in the step 49. The result of calculation of the differential value is obtainable from the difference between the intake air pressure measured this time and that measured last time. Namely, it can be expressed as $dp/dt = P_n - P_{n-1}$ where $P_n$ is the intake air pressure measured this time and $P_{n-1}$ that measured last time. Since this calculation of the differential value of the intake air pressure is made so as to detect the accelerating or decelerating condition of the engine, instead of differentiating the intake air pressure, the intake air value Q or the opening degree of the throttle may be differentiated. Next, the judgement is made if the differential value of the intake air pressure has reached the peak value or not in the step 50. The judgement is made in such a manner that the absolute value of the differential value calculated last time is subtracted from the absolute value of the differential value calculated this time and the difference is examined if it is positive or negative. The calculation is performed by the formula given below.

$$K = |dp_n/dt| - |dp_{n-1}/dt|$$

Figure 7:
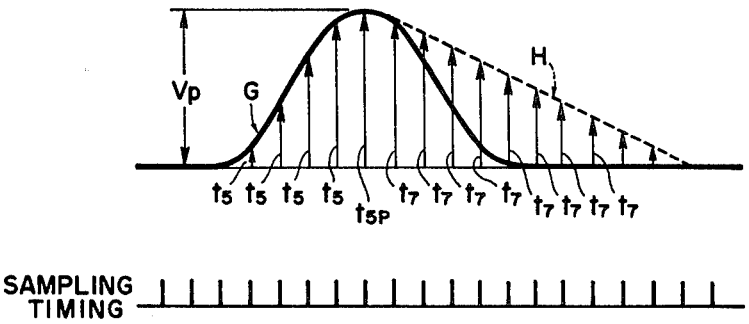
FIG. 7 is a chart showing the relationship between the differential value of the intake air pressure and the corrected injection pulse width calculated in accordance with the differential value of the intake air pressure by use of a digital computer.

Then, the value K is examined if it is positive or negative. The correcting injection pulse width corresponding to the differential value of the intake air pressure is calculated until the differential value of the intake air pressure reaches the peak value, in the step 51. Namely, as shown in FIG. 7, the correcting injection pulse width $t_5$ corresponding the differential value of the intake air pressure is calculated until the differential value G of the intake air pressure reaches the peak value $V_p$. When the peak value is detected by the judgement of the peak value of the differential value in the step 50, a certain pulse width $t_6$ is subtracted from the correcting injection pulse width $t_{5p}$ corresponding to the peak value of the differential value of the intake air pressure, in the step 52, thus obtaining the pulse width $t_7$. The pulse width $t_7$ is calculated in the step 52, and thereafter, $t_6$ is increased by a certain value for the calculation in the succeeding step 52, in the step 53. In these steps 52 and 53, the pulse $t_7$ is obtained which decreases at a certain rate after the differential value G of the intake air value has reached the peak value $V_p$ as shown in FIG. 7. The pulse width $t_5$ or $t_7$ calculated in the step 51 or steps 52 and 53 is corrected by the RPM of the engine in the step 54. Said step 54 is intended for correcting the relationship between the peak value of the differential value of the intake air pressure and the RPM of the engine as shown in FIG. 5. The differential value of the intake air pressure is judged as to whether it is positive or negative in the step 55. This is intended for judging the engine as to whether it is in the accelerating or decelerating condition. When the differential value of the intake air pressure is positive, the engine is in the accelerating condition. Hence, in the step 56, such a calculation is performed that the correcting injection pulse width $t_5$ or $t_7$ is added to the basic injection pulse width $t_4$. When, in the step 55, the differential value is judged as negative, i.e., the engine is in the decelerating condition, such as calculation is performed in the step 57 that the correcting injection pulse width $t_5$ or $t_7$ is subtracted from the basic injection pulse width $t_4$. Thus, the basic injection pulse width $t_4$ is sent out which is calculated from the intake air flow rate Q and the RPM N during the running of the engine at a constant speed, and the basic injection pulse width $t_4$ is corrected by the accelerating or decelerating condition of the engine and the pulse width thus corrected is sent out during the accelerating or decelerating condition of the engine.

What is claimed is:

1. Improvements in a fuel injection control method of an engine comprising the steps of:

(a) calculating the basic fuel injection quantity based on the intake air flow rate of the engine and the RPM of the engine;

(b) detecting the transitional fluctuating value of the engine during acceleration or deceleration of the engine by sensing an engine parameter, calculating a value corresponding to the transitional fluctuating value detected until the transitional fluctuating value detected reaches a peak value, and calculating a value to be decreased from the peak value at a predetermined time constant after the transitional fluctuating value detected has reached the peak value; and (c) correcting the basic fuel injection quantity calculated in said step (a) by the value calculated in step (b);

wherein said improvements further include the steps of:

(d) further correcting the value calculated in said step (b) commensurate to the RPM of the engine;

(e) determining the fuel injection value through correcting the basic fuel injection value calculated in said step (a) by the value calculated in the step (d).

2. A fuel injection control method as set forth in claim 1, wherein the transitional fluctuating value of the engine in the step (b) is detected by differentiating the intake air pressure.

3. A fuel injection control method as set forth in claim 1, wherein the transitional fluctuating value of the engine in the step (b) is detected by differentiating the intake air flow rate.

4. A fuel injection control method as set forth in claim 1, wherein the transitional fluctuating value of the engine in the step (b) is detected by differentiating the opening degree of a throttle.

5. A fuel injection control method as set forth in claim 1, wherein the transitional fluctuating value of the engine in the step (b) is detected by differentiating the opening degree of an accelerating pedal.

6. Improvements in a fuel injection control unit of an engine comprising: an intake air flow sensor; and output-producing RPM detector of an engine; an arithmetic unit for calculating the basic fuel injection quantity of the engine based on the intake air flow rate detected by said intake air flow sensor and the RPM detected by said RPM detector; a detector for detecting the transitional fluctuating value of the engine during acceleration or deceleration of the engine; a first output-producing correcting circuit for correcting the basic fuel injection quantity calculated by said arithmetic unit by an output from said transitional fluctuating value detector; and a fuel injection valve driven in accordance with the output from said first correcting circuit;

wherein: said improvements include a second output-producing correcting circuit for further correcting the output from the first correcting circuit by the output from said RPM detector, with said fuel injection valve being driven in accordance with the output from said second correcting circuit.

7. A fuel injection control unit as set forth in claim 6, wherein said first correcting circuit comprises:

a detector for detecting the peak value of output from said transitional fluctuating value detector; and a first-order lag circuit sending out a value commensurate to an output from said transitional fluctuating value detector until said peak value detector detects the peak value, and sending out a value to be decreased from the peak value at a definite time constant after the detected transitional fluctuating value has reached the peak value.

8. Improvements in a fuel injection control unit of an engine comprising: an intake air flow sensor; an output-producing RPM detector of an engine; an arithmetic unit for calculating the basic fuel injection quantity of the engine based on the intake air flow rate detected by said intake air flow sensor and the RPM detected by said RPM detector; a detector for detecting the transitional fluctuating value of the engine during acceleration or deceleration of the engine; a first output-producing correcting circuit for correcting the basic fuel injection quantity calculated by said arithmetic unit by an output from said transitional fluctuating value detector; and a fuel injection valve driven in accordance with the output from said first correcting circuit;

wherein: said improvements include a second output-producing correcting circuit for further correcting the output from the first correcting circuit by the output from said RPM detector, with said fuel injection valve being driven in accordance with the output from said second correcting circuit;

the RPM detector of the engine comprises: means of generating a pulse at a frequency commensurate to the RPM of the engine; and a flip-flop circuit receiving the output from said pulse generating means;

the arithmetic unit comprises: a first charge-discharge circuit charged commensurate to the pulse width of the pulse from said flip-flop circuit and discharged during a discharge time commensurate to an output from the intake air flow sensor; a first pulse generating circuit sending out a pulse of a pulse width corresponding to the discharge time of said first charge-discharge circuit; a second charge-discharge circuit charged commensurate to a pulse width of a pulse from said first pulse generating circuit and discharged during a discharge time in accordance with a signal given from outside; a second pulse generating circuit sending out a pulse of a pulse width corresponding to the discharge time of said second charge-discharge circuit; and a circuit adding pulses from said first and second pulse generating circuits together on the time axis;

said second correcting circuit comprises: a digital analog converter for converting an output from said flip-flop circuit into a voltage value; and a multiplier for multiplying an output from said converter by an output from said first correcting circuit and feeding the resultant product to said second charge-discharge circuit as a signal from outside.

* * * * *